US005222330A

United States Patent [19]

Krol

[11] Patent Number: 5,222,330

[45] Date of Patent: Jun. 29, 1993

[54] FIXTURE FOR HOLDING CIRCULAR CUTTING TOOL DURING ITS SHARPENING

[75] Inventor: Gregory J. Krol, Crystal Lake, Ill.

[73] Assignee: King Koral, Inc., Arlington Hts., Ill.

[21] Appl. No.: 782,814

[22] Filed: Oct. 25, 1991

[51] Int. Cl.[5] ..... B24B 19/00; B25B 5/02; B25B 5/06; B25B 5/16

[52] U.S. Cl. ..... 51/225; 51/217 R; 51/220; 269/47; 269/246; 269/252; 269/277

[58] Field of Search ..... 51/216 R, 216 A, 216 T, 51/216 ND, 216 H, 217 R, 217 A, 217 T, 217 S, 218 R, 218 A, 218 T, 220, 225; 269/47, 52, 191, 246, 250, 252, 277, 279

[56] References Cited

U.S. PATENT DOCUMENTS

| | | | |
|---|---|---|---|
| 2,470,530 | 5/1949 | Stryhal | 51/220 |
| 2,767,531 | 10/1956 | Keller | 51/220 |
| 2,809,480 | 10/1957 | Hunt et al. | 51/225 |
| 2,886,080 | 5/1959 | Rappeport | 269/245 |
| 3,236,516 | 2/1966 | Young | 269/246 |
| 3,376,674 | 4/1968 | Ernesto | 51/217 R |

*Primary Examiner*—Bruce M. Kisliuk
*Assistant Examiner*—John A. Marlott
*Attorney, Agent, or Firm*—Charles F. Lind

[57] ABSTRACT

The disclosed fixture has a main clamping piece defining several differently sized smooth bores, the locations and sizes of which are selected to receive and hold different central mounting mechanisms of incompatible cutting tools, with the intended cutting edge on each cutting tool then spaced beyond and clear of the clamping piece. A stop is provided in accurate vertical registry with each bore, allowing the fixture to be secured to a grinder bed and located accurately relative to the grinding wheel, before the cutting tool is mounted thereon and any sharpening begins. Before being tightened down, the cutting tool can be rotated selectively in the fixture to accurately set where the grinding wheel will sharpen the cutting edge, and a second clamping piece then secures the cutting tool rigidly in the fixture. Special mounting pins cooperate respectively with the different cutting tool central mounting mechanisms to hold the different cutting tools relative to its proper fixture bore.

20 Claims, 4 Drawing Sheets

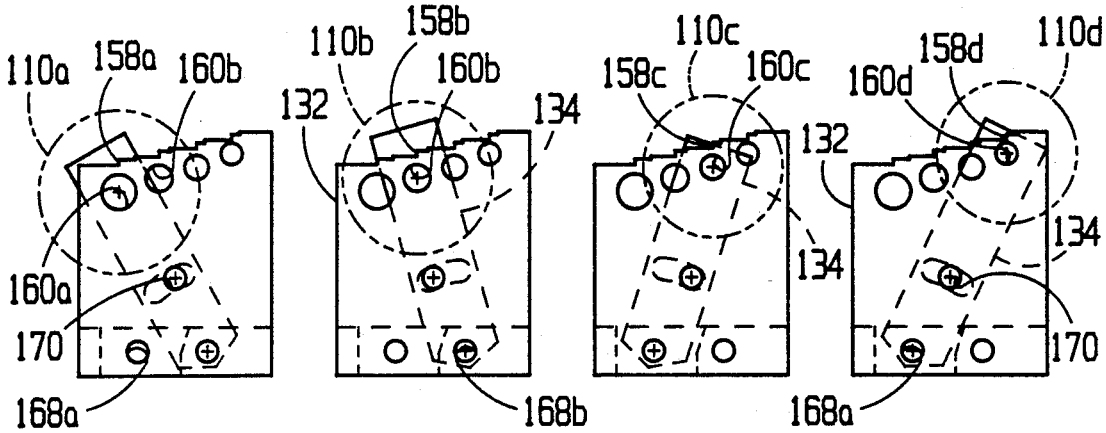
Fig. 9a Fig. 9b Fig. 9c Fig. 9d
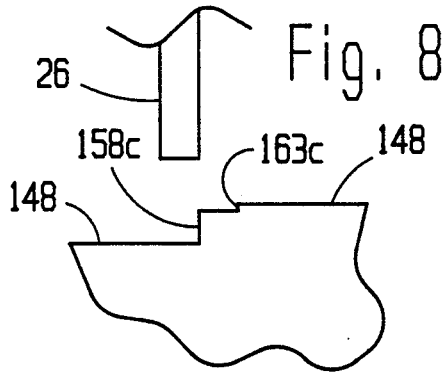
Fig. 8
Fig. 6
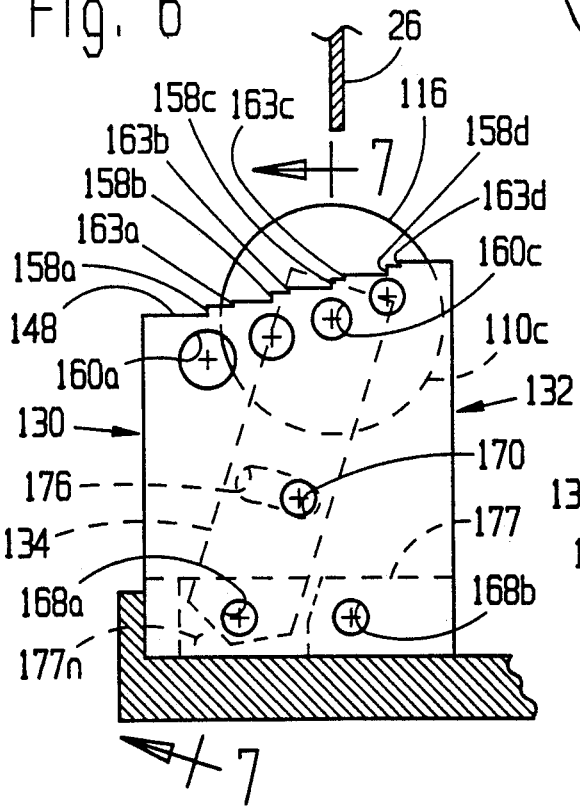
Fig. 7
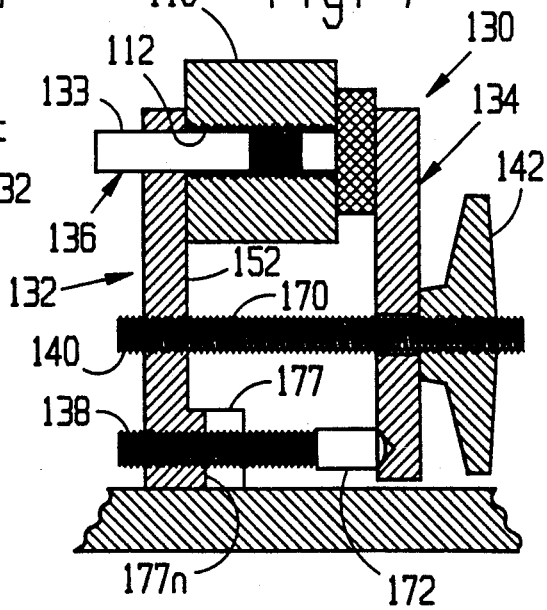

Fig. 13a
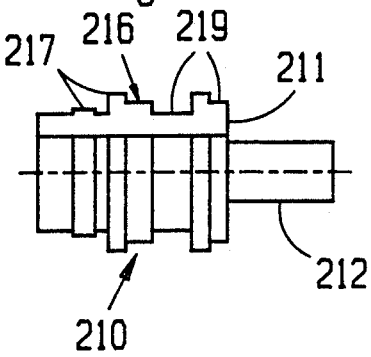
Fig. 13b
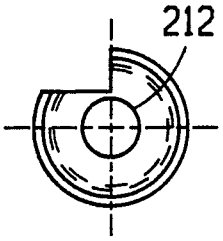
Fig. 13c
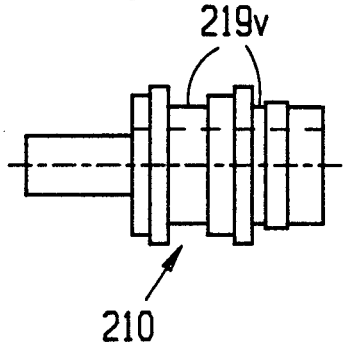
Fig. 12
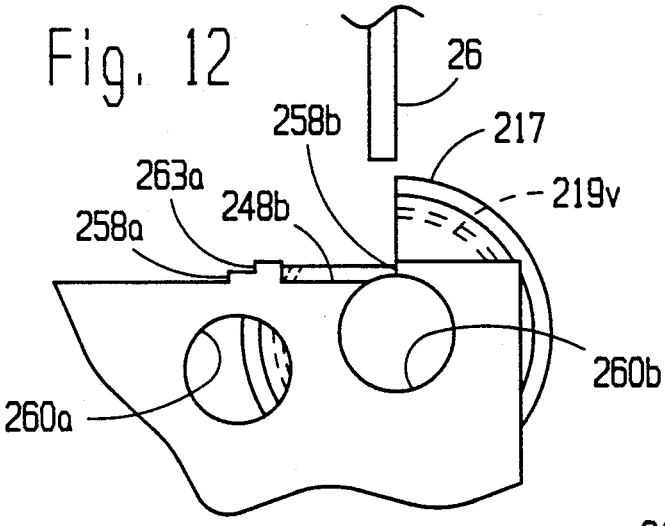
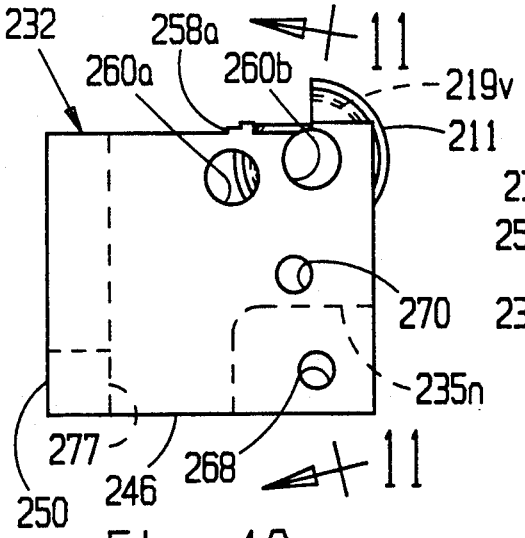
Fig. 10
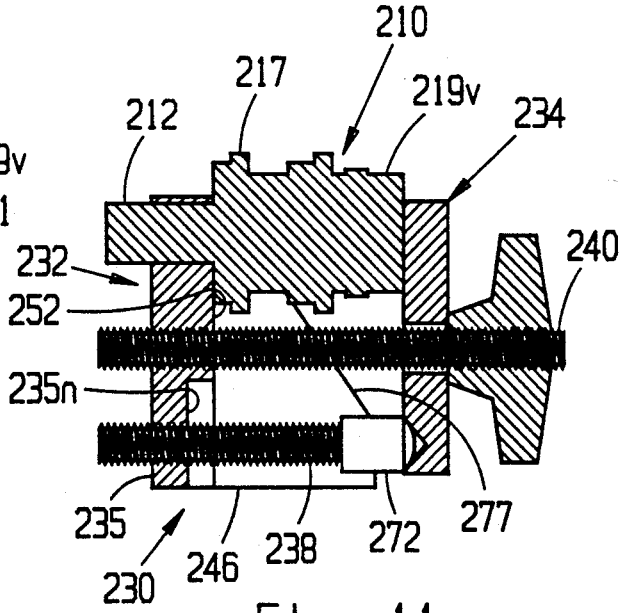
Fig. 11

FIXTURE FOR HOLDING CIRCULAR CUTTING TOOL DURING ITS SHARPENING

BACKGROUND OF THE INVENTION

In an automatic screw machine, an elongated work piece is turned about its longitudinal center axis and a circular cutting tool held laterally adjacent the work piece is advanced radially toward and against the work piece to remove material according to the profile of the cutting tool. With multiple spindles, several cutting tools of different profiles (rough cut progressing to finish cut) will be used sequentially on each work piece as it is indexed between the separate work stations in being formed into the desired end product.

In most situations, the cutting tool is formed from a cylindrical blank of tool steel having a concentrically centered longitudinal mounting bore extended between opposite end faces. The outer surface of the blank is contoured to define generally circumferential ridge and valley areas that in cross section are related to the exact profile of the desired cutting edge. The actual cutting edge on the circular cutting tool is defined at the corner intersection of the blank's (or tool's) peripherial profile and a trailing face extended inwardly therefrom.

As the controlled tolerances of any product formed with a circular cutting tool relates directly to the accuracy of the cutting tool profile and its cutting edge, such must be formed and sharpened accurately as needed.

Typically, tool specialists fabricate the cutting tool blanks to order, as noted, with appropriate and accurate rough to finish cut peripheries; and with a radial slot ground in each tool periphery to expose and define an initial cutting edge. The tool user may further sharpen the initial cutting edge before use, but thereafter most typically will sharpen all new cutting edges as needed because of wear during use. This sharpening is done by removing a pie-shaped portion of the tool blank immediately next to and including the original cutting edge.

Depending on its size and complexity, each cutting tool blank may typically cost the tool user upward of several hundred dollars, necessitating effective tool management. One aspect of effective tool management depends directly on the ability to sharpen the cutting edge accurately and economically, for providing extended tool usage and reduced tool costs.

Different makes of screw machines have different mechanisms for holding the cutting tools, and for locating their cutting edges or orienting their trailing faces therefrom relative to the work piece. The cutting tools for the different makes of screw machines are not interchangeable. The typical tool user further may be operating in a machine shop that has several different makes of screw machines. Tool management is complicated because of this factor, particularly when sharpening such tools.

In field-sharpening the cutting tool, many tool users merely clamp the tool in a vice, and "eyeball" the grinding of the tool's cutting edge. However, this lack of guidance for accurately setting and making a grinding pass provides wasteful and poor tool management: timewise, tolerance-wise, and material removal-wise.

SUMMARY OF THE INVENTION

This invention relates to, and a basic object of the present invention is to provide, a fixture (or a family of fixtures) suited to hold and/or index different circular cutting tools, as might be used on automatic screw machines, accurately relative to a grinder, to allow the cutting tool to be sharpened quickly, accurately and economically, virtually independently of the cutting tool's size, its mounting mechanism, its trailing edge orientation, and/or the screw machine on which it is to be used.

BRIEF DESCRIPTION OF THE DRAWINGS

Further objects, advantages and features of the present invention will appear from the following disclosure and description, including as a part thereof the accompanying drawings, in which:

FIG. 6 is an elevational view similar to FIG. 2, except of a second embodiment of the inventive fixture;

FIG. 7 is an elevational sectional view, as taken generally from line 7—7 in FIG. 6;

FIG. 8 is an enlarged elevational view of part of FIG. 6;

FIGS. 9*a*, 9*b*, 9*c* and 9*d* are elevational views similar to FIG. 6, except showing the use of the fixture holding different cutting tools;

FIG. 10 is an elevational view similar to FIGS. 2 and 6, except of yet a third embodiment of the inventive fixture;

FIG. 11 is an elevational sectional view, as taken generally from line 11—11 in FIG. 10;

FIG. 12 is an enlarged elevational view of part of FIG. 10; and

FIGS. 13*a*, 13*b* and 13*c* are elevational views of a shaving cutting tool that can be sharpened in the fixture of FIGS. 10–12.

DETAILED DESCRIPTION OF ILLUSTRATED EMBODIMENTS

In this specification, general numbers will be assigned to components illustrated in certain figures, while the same number with a suffix letter and a related number with a hundred-digit preface number may also be assigned to a similar component illustrated in a different specific figure. This approach makes emphasis that the cutting tools and fixtures (and other component) in fact may differ, such as in size or shape, while yet otherwise notes they are also closely related or similar. Likewise, a summary reference to any component by using only the identification of a specific embodiment does not automatically exclude the same component of the other embodiments.

Figure 2:
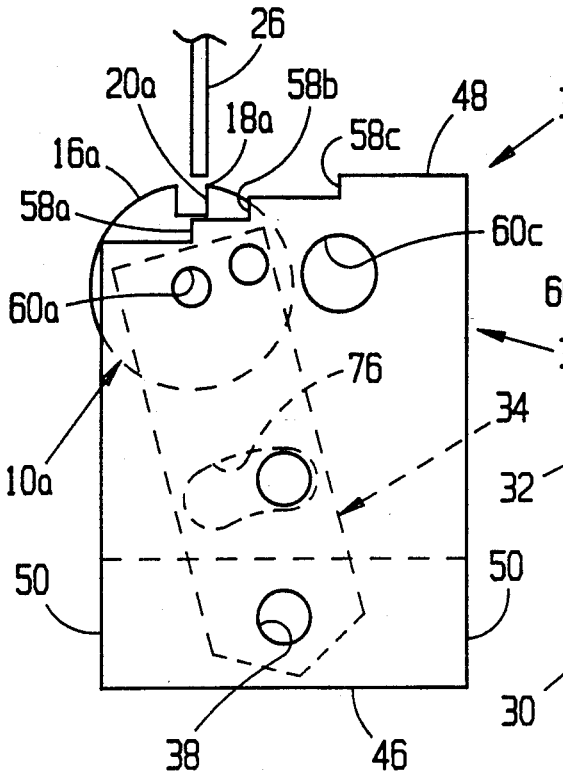
FIG. 2 is an elevational view of the assembly illustrated in FIG. 1, looking normal to the rotational axis of the grinding wheel.
Figure 3:
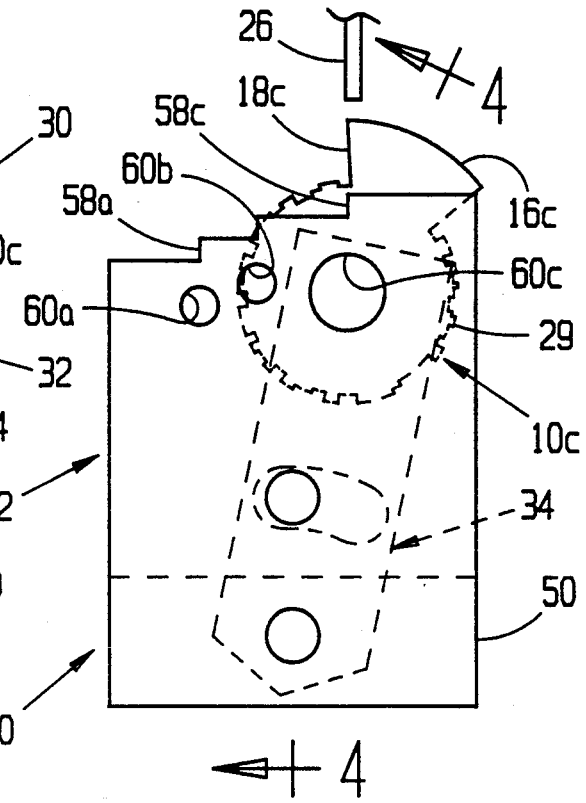
FIG. 3 is an elevational view similar to FIG. 2, except showing a second cutting tool held relative thereto.
Figure 4:
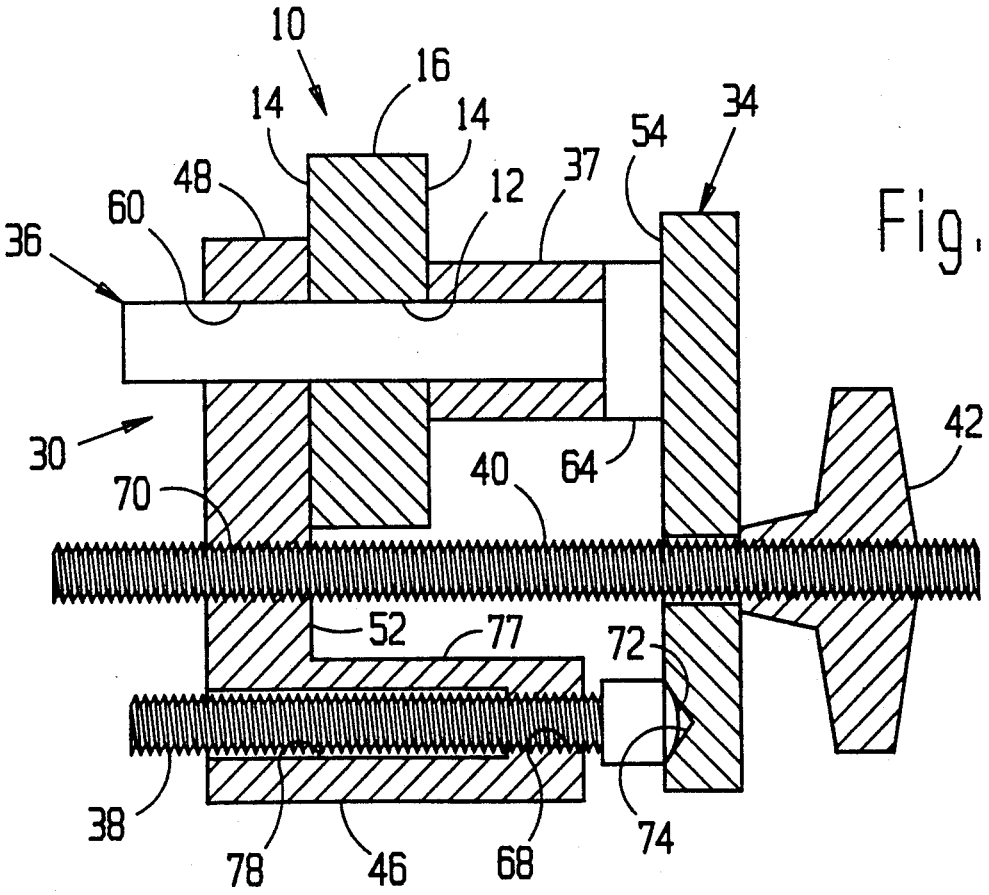
FIG. 4 is an elevational sectional view, taken generally from line 4—4 in FIG. 3.

One form of circular cutting tool 10 is illustrate in FIGS. 1–4, having a mounting bore 12 (FIG. 4) extended between opposite generally parallel side faces 14, and having a peripherial profile face 16 concentrically surrounding the mounting bore. The cutting edge 18 is defined at the corner intersection of the profile face 16 at a section cut or trailing face 20 extended generally inwardly therefrom. The mounting bore 12 is FIG. 4 is illustrated as being smooth, while an alternate mounting bore 112 in cutting tool 110 in FIG. 7 is illustrated as being threaded. It will be understood that each configuration depends on the type of holding shank used on its screw machine (neither being shown).

Figure 1:
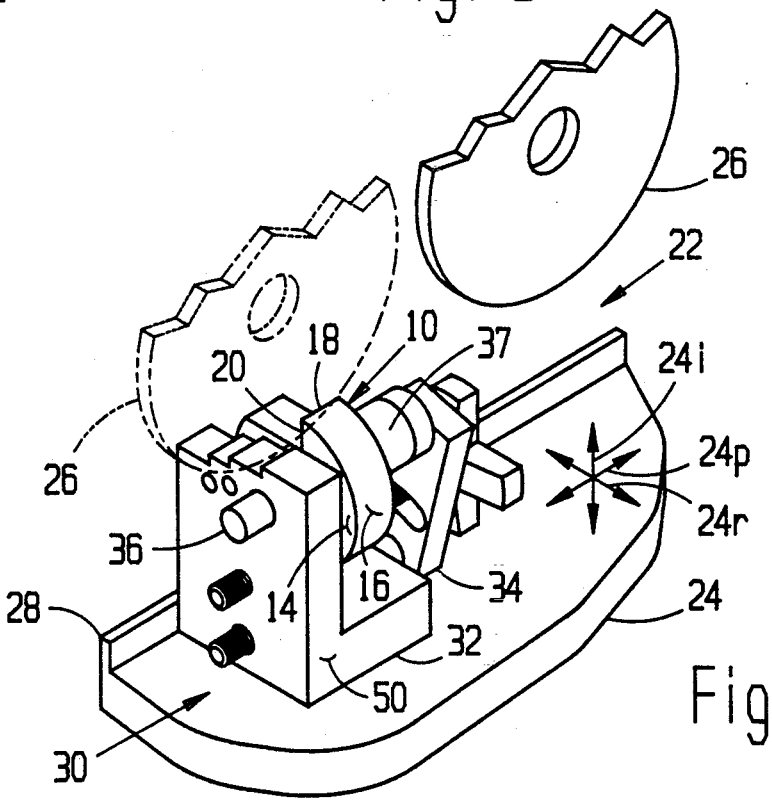
FIG. 1 is a perspective view of a typical grinder bed and wheel, showing a first embodiment of the inventive fixture held thereon and holding a first cutting tool relative thereto as when sharpening a cutting edge thereon.

Common components of grinder 22 are also illustrated in FIG. 1, including bed 24 and overlying powered grinding wheel 26. The bed 24 may typically have an edge lip 28 to allow such components to be accurately squared up thereon. A clamping fixture 30 is releasably but fixedly held relative to the grinder bed 24, and it in turn releasably but fixedly holds the circular cutting tool 10 for sharpening the cutting edge 18 thereon.

The grinding wheel 26 is powered about rotational axis 26*r*, while being accurately referenced relative to the bed 24. The bed 24 can be indexed along axis 24*i* extended normal to the rotational axis 26*r*, and along axis 24*r* extended parallel to the rotational axis 26*r* for setting up operative positions relative to the cutting tool held in the fixture. The bed can also be powered for automatic passes along axis 24*p*, normal to both axes 24*r* and 24*i*. Two relative positions of the grinding wheel 26 and fixture 30 are illustrated: a spaced-apart position, (with the wheel 26 shown solid), and proximate position (with the wheel 26 shown in phantom).

The illustrated clamping fixture 30 (see FIG. 5 also) consists of clamping pieces 32 and 34, locating pin 36 and optional spacer 37, squaring stud 38, and tightening stud 40 and nut 42.

The clamping piece 32 is generally L-shaped, having a bottom face 46 and opposed top face 48, side guide faces 50 extended transversely upwardly from the bottom face, and clamping face 52 extended transversely downwardly from the top face 48. The clamping piece 34 is generally elongated, having clamping face 54.

The one clamping piece 32 can be squared relative to the bed 24 and the powered grinding wheel 26, with its bottom face 46 against bed 24 and its side guide face 50 against bed lip 28. As clamping piece 32 is made of steel and is magnetic, conventional magnetic clutch means on the grinder bed will fixedly hold it as so positioned.

The top face 48 is generally perpendicular to the side faces 50, and is stepped having several stops thereon for accurately setting the location of the grinding wheel 26 relative to the fixture 30 and consequently relative to any cutting tool held thereby. Three stops 58*a*, 58*b* and 58*c* are illustrated in fixture 30, and are extended generally parallel to side guide faces 50.

In centered vertical registry below the stops 58*a*, 58*b* and 58*c*, mounting openings 60*a*, 60*b* and 60*c* respectively are provided in the clamping face 52 and extend through the clamping piece 32. The mounting openings are sized to correspond respectively with mounting bore sizes of different cutting tools to be held while being sharpened in the fixture, and the face defining each mounting opening is smooth. The center axis of each mounting opening is parallel to the bottom and side guide faces 46 and 50, and each opening 60 is spaced from the top face 48 below its respective stop 58 to provide that the profile face 16 of any held cutting tool is projected well beyond the clamping pieces 32 and 34, and can be moved to lie in the operative path of the grinding wheel 26.

Figure 5:
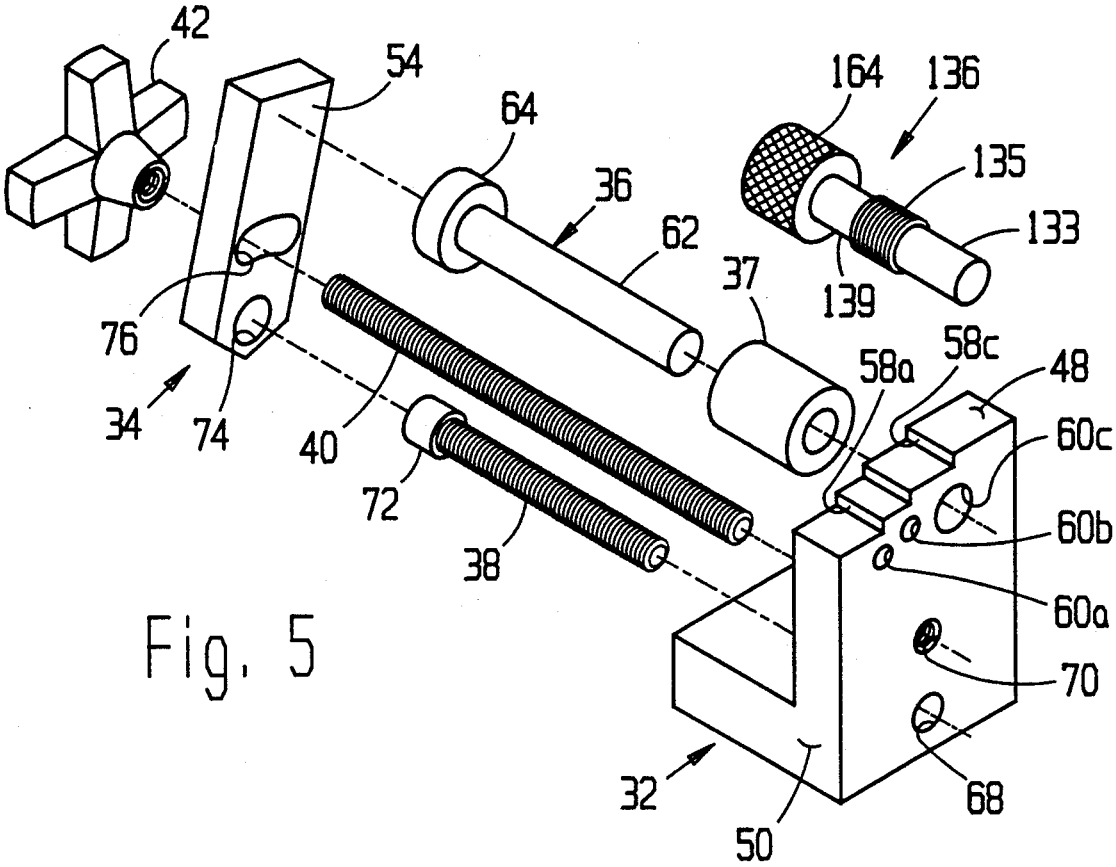
FIG. 5 is an exploded perspective view of components used in making up the inventive fixture.

Although only one locating pin 36 or shank means is illustrated in FIG. 5 (pin 36*c* aligned with and for opening 60*c*), three such locating pins will be used with the illustrated fixture 30, respectively sized for the mounting openings 60*a*, 60*b* and 60*c*. Each pin will have a smooth shank 62 sized to fit removably but snuggly into and through the smooth mounting bore 12 of its cutting tool 10 and its intended clamping face opening 60. As illustrated, a sleeve spacer 37 may optionally be used (depending on the width of the cutting tool), fitting on the pin shank 62 and being trapped between the underside of enlarged pin head 64 and the cutting tool. The clamping face 54 of clamping piece 34 butts against the exposed top of pin head 64.

Also provided in clamping piece 32 are several threaded holes 68 and 70, respectively used to receive and hold the squaring stud 38 and tightening stud 40. The squaring stud 38 has a spherically convex end 72 that becomes centered within conically concave dimpled face 74 on clamping piece 34; and the clamping piece 34 when so positioned is sized to overlie and contain the pin head 64. The clamping piece 34 has a curved slot or opening 76 designed to fit over and receive the tightening stud 40, while allowing for different angluar orientations of the clamping piece 34 around the squaring stud 38 while overlying different mounting pins held in different mounting openings 60, for each operative pin-opening combination of the fixture.

The squaring stud 38 will be threadably adjusted to orient the clamping face 54 generally flush against the pin head 64, whereupon nut 42 can be tightened down on the stud 40 to clamp the cutting tool rigidly in the fixture. As illustrated in FIG. 4, the threaded hole 68 in clamping piece 32 may extend only part way through base 77, and a larger opening 78 may extend through the remainer.

The fixture 30 can be used to mount and hold three different types of cutting tools, each having a mounting bore 12 that corresponds to one of the mounting openings 60 on the fixture. FIGS. 2 and 3 show two different cutting tools 10*a* and 10*c* held respectively at different mounting openings 60*a* and 60*c* on the same fixture 30.

The cutting tool 10*a* moreover is illustrated as being substantially new from a fabricator, with a narrow slot in profile face 16*a* defining an initial cutting edge 18*a* and a trailing face 20*a*. Tool 10*c* is more representative of one sharpened many times (leaving only a small portion of usable profile surface 16*c* and leaving also an uneven exposed body surface 29 generated by the different grinding depths of prior sharpening efforts). Moreover, FIG. 2 illustrates the alignment of the grinding wheel 26 after the sharpening pass has formed the cutting edge 18*a* on cutting tools 10*a*, while FIG. 3 is representative of the interferring tool-wheel orientation with cutting edge 18*c* being dull and prior to the sharpening pass.

When the cutting tool has a threaded mounting bore, a threaded locating pin 136 (see FIGS. 5 and 7) will be used instead of smooth shank pin 36. Three different threaded pins would be needed with fixture 30, each pin having a threaded intermediate section 135 sized to fit threadably into the mounting bore of its cutting tool, and a smaller outer diameter smooth shank 133 sized to fit completely through the cutting tool 10 and complimentarily into its intended smooth bore clamping face opening 60. The threaded section 135 will extend axially a sufficient distance to provide a sound connection with the cutting tool, but it need not extend to the head 164, as illustrated by smaller diameter intermediate non-threaded section 139.

The use of threaded locating pin 136 is illustrated in FIGS. 6–9, along with alternative embodiment fixture 130 having clamping pieces 132 and 134. The clamping piece 132 has a stepped top face 148 with four stops 158*a*, 158*b*, 158*c* and 158*d* thereon, and four differently-sized mounting openings 160*a*, 160*b*, 160*c* and 160*d* centered respectively vertically below the stops. The clamping piece 132 has a single threaded hole 170 to hold tightening stud 140, and a pair of threaded holes 168*a* and 168*b* used alternatively to hold squaring stud 138. Also, the base 177 of the clamping piece 132 is notched away as at 177*n* adjacent the threaded hole 168*a*, to allow the end 172 of the squaring stud to be tightened in closer to the clamping face 152, for accomodating cutting tools of narrow widths.

By using two threaded holes 168*a* and 168*b*, a single clamping piece 134 can be used in all alternative clamping positions of FIGS. 9*a*–9*d*. Specifically in FIGS. 9*a* and 9*b*, centering stud hole 168*b* is used for holding cutting tools 110*a* and 110*b* in openings 160 *a* and 160 *b*, respectively; and in FIGS. 9*c* and 9*d*, centering stud hole 168*a* is used for holding cutting tools 110*c* and 110*d*, respectively in openings 160*c* and 160*d*.

This fixture 130 also illustrates secondary stops or indicia marks 163*a*, 163*b*, 163*c* and 163*d* on the top face 148 each spaced from its adjacent respective stop 158*a*, 158*b*, 158*c* and 158*d* a specific offset distance. The second stops or indicia marks can be used alternatively for setting up or locating the relative position of the grinding wheel 26 and fixture.

In this regard, although no one specific offset between the main and secondary stops will work for all applications, the tooling trade generally recognizes the need to have the cutting edge 18*a* (see FIG. 2) offset slightly below top-dead-center relative to being aligned radially of the geometric longitudinal tool center (at mounting opening 60*a*). This can be appreciated by the fact that typically the trailing face 20*a* from the cutting edge 18*a* is not aligned radially of the geometric longitudinal tool center, but is offset below this center. A typical offset is small however, such as between 1/16" and ⅛". In making the fixture, the specific offset spacing between each of the paired main and secondary stops would be set based on the tooling trade's recommended offset, based on the size of the mounting bore associated with the main stop. Factors that influence the offset include the radial distance of the cutting edge 18 from the cutting tool geometric center, the work piece material, and the type of screw machine.

Related secondary stops or indicia marks (not shown) can also be used on the top face 48 of the fixture 30, each spaced from its adjacent paired main stop.

Yet another embodiment fixture 230 is illustrated in FIGS. 10–12, being particularly suited for sharpening a cutting tool 210 commonly known as a shaving tool. The shaving tool illustrated differs from the cutting tools 10 and 110 in several ways, one being that it has an integral shank 212 projecting axially from its tool body 211. The shaving tool further is intended more for finish cuts, whereby profile surface 216 may have a complex pattern of peaks 217 and valleys 219 that define the intended close tolerance contours of the end product. For convenience of disclosure, the profile surfaces of cutting tools 10 and 110 have been illustrated merely as cylindrical, although typically they too would be irregular and have peaks and valleys. The deep valleys 219*v* moreover may be of relatively small overall diameter (possibly less than an inch), and the cutting edge offset may be quite small (possibly less than 0.010") or may lead the top dead center alignment, or both.

The fixture 230 illustrated has the clamping pieces 232 and 234, where the clamping piece 232 is L-shaped (but on its side) having vertical webs 235 and 277 together defining substantially planar bottom face 246 and side face 250. The clamping piece 232 also has threaded holes 268 and 270 and to hold squaring stud 238 and tightening stud 240, respectively. The web 235 of the clamping piece 232 is notched away as at 235*n* adjacent the threaded tap 268, to allow the end 272 of the squaring stud to be tightened in even beyond the clamping face 252, for accomodating cutting tools of vary narrow widths.

The clamping piece 232 has one closed mounting opening 260*a* with its overlying main and secondary stops 258*a* and 263*a*; and has another mounting opening 260*b* which is open and noncontinuous along an upper portion. Reference 258*b* is defined at the upper edge of the noncontinuous opening, which edge is formed at the top dead center of the opening. With the upper periphery of the mounting opening missing in the direction away from the stop 258*b*, and with top face 248*b* below and extended some distance from the stop 258*b*, the grinding wheel 26 can be indexed against the stop as required to center the cutting wheel 26 relative to the fixture (and thus the tool to be carried in the mounting opening 20*b*). Moreover, the grinding wheel can be moved along its operative passes to the needed depths without adversely gouging out part of the fixture.

SUMMARY OF THE OPERATION

It may well be that for best utilization of the invention, each individual fixture 30 would be sized and shaped to sharpen cutting tools 10 commonly used on a single make or brand of screw machine (not shown). Thus, although the tool sizes and profiles, etc. may well vary, the similarities of mounting means would allow virtually all of the different cutting tools used on different machines of the same make or brand to be sharpened accurately, easily and quickly on a single fixture. Conversely, a tool user having different makes or bands of screw machines, would most likely need different fixtures for sharpen the different cutting tools used on the different respective brands of machines. However, as possibly as few as six different makes or brands of screw machines comprise most usage today, a family of six different related fixtures would serve the tool user for sharpening virtually all of the cutting tools commonly used today.

Once a suitable fixture had been provided for the cutting tool that needed to be sharpened, the fixture would be squared up on the grinder bed 24 against a bed lip 28, and secured relative thereto by the magnetic bed clutch. The bed would then be indexed as needed along the varying axes 24*r*, 24*p* and 24*i* to position the grinding wheel 26 against the appropriate top face stop 58, noting this tool-centered bed position. The bed would then be indexed along the axis 24*r* to the specific offset needed for the cutting tool.

This indexed offset position would be recorded and retained during the sharpening effort, and could also be used for attempting to duplicate subsequent sharpening efforts of the same tool. Likewise, this referenced position could be used as a starting location to initiate changes, such as varying the offset or any other factor in attempting in a subsequent sharpening effort to obtain better cutting tool performance.

Alternatively, the grinding wheel 26 could be lined up with the appropriate secondary stop or indicia mark 163, instead of the main stop. This could be done by establishing actual contact between the secondary stop and grinding wheel, or possibly by "eyeballing" the alignment once the secondary stop and grinding wheel were brought into close proximity.

The bed and grinding wheel components would then be separated clear of one another, and the cutting tool would be mounted loosely but accurately in place on its complimentary locating or mounting means, and the squaring stud would be adjusted to seat the clamping piece 34 flush against the head of the mounting pin. Until clamped tightly, the cutting tool is free to be rotated, even incrementally, to the specific orientation needed to remove sufficient but not excessive tool material adjacent the old cutting edge, for grinding a true new cutting edge and trailing face therefrom. When so suitably oriented, the cutting tool can be fixed securely relative to the fixture by tightening nut 42.

The grinding wheel can then be moved operatively along its grinding path along axis 24*p*, to remove from the cutting tool only that selected segment-like portion of material required to define the new cutting edge and trailing face therefrom. It is preferred to use multiple operative grinding wheel passes, each being incrementally indexed along axis 24*i* until achieving the required depth of cut. Alternatively, a single sharpening pass could be made with the grinding wheel set at the required finished depth of cut, but this approach requires great car as it can burn up the cutting tool.

The inventive fixtures thus readily accomodate sharpening cutting tools intended for use on different screw machines and having different mounting bore and shank sizes and styles (smooth, threaded and unitary). The top face stops provide for easy, fast and accurate set-up of the fixture (and later the clamped cutting tool thereon) relative to the grinder wheel, thereby allowing for accurate sharpening of the cutting tool. The multiple pass incremental radial shaving of material from the cutting tool subjects the profile surface to intense sharpening action and heat for only initial brief durations (thereafter only polishing lightly with the grinder side face) for effective tool material temperature and temper control. These factors provide for an accurately sharpened cutting tool edge for yielding closer tolerances of the finished end product, and extending the useful tool life.

While only specific embodiments of the invention have been illustrated, variations can be made without departing from the inventive concept. Accordingly, the invention is to be limited only by the scope of the following claims.

What is claimed as my invention is:

1. A fixture for releasably holding a circular cutting tool, having side faces and concentrically arranged central mounting means and peripheral profile surface means, fixed relative to a powered grinding wheel while sharpening its cutting edge at the profile surface means, comprising the combination of first and second clamping pieces each having a clamping face thereon;

means for releasably positioning and holding the clamping pieces relative to one another with the clamping faces facing one another;

first stop means on the first clamping piece suited when engaged by the nonoperating grinding wheel for accurately setting the relative positions of the grinding wheel and the first clamping piece;

means on the first clamping piece having accurate registry and sufficiently close proximity relative to the first stop means, operable to cooperate with the central mounting means of the cutting tool for rotatably holding the cutting tool with the intended cutting edge spaced beyond and clear of the first clamping piece and selectively oriented for intended exposure to the grinding wheel, and with the side faces of the cutting tool operatively sandwiched between the clamping faces of the clamping pieces; and means for releasably and adjustably tightening the clamping pieces together for rigidly clamping the cutting tool as so located relative to the fixture.

2. A fixture according to claim 1, further comprising said central mounting means of said cutting tool including a smooth bore opening onto the side faces of the cutting tool; and said means on the first clamping piece to cooperate with the central mounting means of the cutting tool including a smooth bore opening onto the clamping face of the first clamping piece, and pin means having smooth shank sections sized respectively to be removably but snuggly fitted through the smooth bores of the cutting tool and the first clamping piece.

3. A fixture according to claim 1, further comprising said central mounting means of said cutting tool including a threaded bore opening onto the side faces of the cutting tool; and said means on the first clamping piece to cooperate with the central mounting means of the cutting tool including a smooth bore opening onto the clamping face of the one clamping piece, and pin means having adjacent threaded and smooth shank sections respectively sized to be threaded into the threaded bore of the cutting tool and to be removably but snuggly fitted through the smooth bore of the first clamping piece.

4. A fixture according to claim 1, further comprising said central mounting means of said cutting tool including a smooth shank unitary with the cutting tool and projecting away from one of the side faces thereof, and said means on the first clamping piece to cooperate with the central mounting means of the cutting tool including a smooth bore opening onto the clamping face of the one clamping piece and size to removably but snuggly receive and hold the smooth shank of the cutting tool.

5. A fixture according to claim 1, further comprising said means on the first clamping piece to cooperate with the central mounting means of the cutting tool including a bore opening onto the clamping face of the first clamping piece and sized to receive the central mounting means, and said bore being noncontinuous over an open segment and said first clamping piece presenting opposing axially extended edges at the open segment of the bore, and one of the open segment edges and said first stop means on the first clamping piece being one and the same, and suited when engaged by the nonoperating grinding wheel for accurately setting the relative positions of the grinding wheel and the first clamping piece.

6. A fixture according to claim 1, further comprising secondary stop means on said first clamping piece, said secondary stop means being spaced from the first stop means a known small distance corresponding to an intended offset of the cutting edge on the peripheral profile surface means from the concentrically arranged central mounting means of the cutting tool and suited when aligned with the nonoperating grinding wheel for accurately setting the relative positions of the grinding wheel and the first clamping piece.

7. A fixture according to claim 1, further comprising said fixture having second stop means spaced from the first stop means, and said means on the first clamping piece to cooperate with the central mounting means of the cutting tool including first and second smooth bores each opening onto the clamping face of the first clamping piece, the first smooth bore and first stop means being respectively paired and the second smooth bore and second stop means being respectively paired, the paired bore and stop means being spaced apart and appropriately sized operable for accurately setting the relative positions of the grinding wheel and the first clamping piece and for rotatably holding different respective cutting tools separately and with the intended cutting edge thereon spaced beyond and clear of the first clamping piece and selectively oriented for intended exposure to the grinding wheel when sharpening the cutting tool.

8. A fixture according to claim 1, further comprising said means for releasably and adjustably tightening the clamping pieces together including the first clamping piece having first and second respectively spaced threaded holes therein, a squaring stud threaded into the first hole and a tightening stud threaded into the second hole, and said studs cooperating with the second clamping piece.

9. A fixture according to claim 1, further comprising said means for releasably and adjustably tightening the clamping pieces together including said second clamping piece having an intermediate opening fitted over the tightening stud, the squaring stud cooperating with the second clamping piece spaced from the clamping face thereon operable to square said clamping face against the adjacent side face of the cutting tool, and nut means cooperating with the tightening stud to draw the clamping pieces together.

10. A fixture according to claim 1, further comprising said squaring stud and the second clamping piece having complimentry cooperating concave and convex faces, operably for providing a floating flush adjustment between the side faces of the second clamping piece and the cutting tool.

11. A fixture according to claim 1, further comprising the first clamping piece having a top face, and the clamping face on the first clamping piece being extended transversely downwardly from the top face, and said first stop means being formed on the top face.

12. A fixture according to claim 11, further comprising the first clamping piece having a bottom face opposing said top face, a side guide face extended transversely upwardly from the bottom face, the powered grinding wheel being part of a grinder and the grinder also having a movable bed with a guide lip thereon, and the first clamping piece being adapted to be squared on the grinder with its bottom face against the bed and its side guide face against the guide lip.

13. A fixture according to claim 1, further comprising said means on the first clamping piece having accurate registry relative to the stop means including a smooth bore opening onto the clamping face of the first clamping piece, and said smooth bore being extended parallel to the side guide face and the stop means of the first clamping piece.

14. A fixture for releasably holding different incompatible circular cutting tools, each having side faces and concentrically arranged central mounting means and peripheral profile surface means, fixed relative to a powered grinding wheel while sharpening its cutting edge at the profile surface means, comprising the combination of first and second clamping pieces each having a clamping face thereon;

means for releasably positioning and holding the clamping pieces relative to one another with the clamping faces facing one another;

first and second stop means on the first clamping piece and corresponding first and second smooth differently sized bore means on the first clamping piece, and the first stop and bore means being respectively paired and the second stop and bore means being respectively paired and each respectively paired stop and bore means having accurate registry relative to one another;

each stop means when separately engaged by the nonoperating grinding wheel being operable for accurately setting the grinding wheel relative to its respectively paired bore means;

each bore means having sufficiently close proximity relative to its respectively paired stop means operable to cooperate with its correspondingly sized central mounting means of the cutting tool for rotatably holding the cutting tool individually with its intended cutting edge spaced beyond and clear of the first clamping piece and selectively oriented for intended exposure to the grinding wheel, and with the side faces of the cutting tool operatively sandwiched between the clamping faces of the clamping pieces; and means for releasably and adjustably tightening the clamping pieces together for rigidly clamping the cutting tool as so located relative to the fixture.

15. A fixture according to claim 14, further comprising said tightening means including the first clamping piece having first and second threaded holes therein spaced apart and spaced progressively from the clamping face thereon, a squaring stud threaded into the more remote second hole and a tightening stud threaded into the nearer first hole, and said second clamping piece having an intermediate opening fitted over the tightening stud, the squaring stud cooperating with the second clamping piece spaced from the clamping face thereon operable to square said clamping face thereon operable to square said clamping face against the adjacent side face of the cutting tool, and nut means cooperating with the tightening stud to draw the clamping pieces together.

16. A fixture according to claim 15, further comprising said squaring stud and the second clamping piece having complimentry cooperating concave and convex faces, operable for providing a floating flush adjustment between the clamping face of the second clamping piece and the side face of the cutting tool.

17. A fixture according to claim 15, further comprising yet other stop means on said first clamping piece each paired with and spaced from its respective first stop means a known small distance corresponding to an intended offset of the cutting edge from the central mounting means of the cutting tool and suited when aligned with the nonoperating grinding wheel for alternatively setting the relative accurate positions of the grinding wheel and the first clamping piece.

18. A fixture according to claim 15, further comprising the first clamping piece having a top face and the clamping face on the first clamping piece being extended transversely downwardly from the top face, and said first and second stop means being formed on the tope face; the first clamping piece having a bottom face opposing said top face, and a side guide face extended transversely upwardly from the bottom face; and the powered grinding wheel being part of a grinder and the grinder having a movable bed with a guide lip thereon, whereupon the first clamping piece is suited to be squared on the grinder with its bottom face against the bed and its side guide face against the guide lip.

19. A fixture according to claim 18, further comprising said smooth bore means in the first clamping piece being extended parallel to the side guide face and the first and second stop means of the first clamping piece.

20. A fixture according to claim 19, further comprising the addition of a third threaded hole spaced from said second threaded holes, operable for holding the squaring stud in an alternative position, instead of it being in the second threaded hole, and aligning the second clamping piece in an alternative position to cooperate with the squaring stud in the third threaded hole for holding a different cutting tool respectively held relative to the second smooth bore means in the first clamping piece.

* * * * *